US009523370B2

(12) United States Patent
Goenka

(10) Patent No.: US 9,523,370 B2
(45) Date of Patent: Dec. 20, 2016

(54) BLOWER WITH CURVED BLADES

(71) Applicant: Halla Visteon Climate Control Corp., Daejeon (KR)

(72) Inventor: Lakhi Nandlal Goenka, Ann Arbor, MI (US)

(73) Assignee: HANON SYSTEMS, Daejeon-Si (KR)

( * ) Notice: Subject to any disclaimer, the term of this patent is extended or adjusted under 35 U.S.C. 154(b) by 396 days.

(21) Appl. No.: 14/246,289

(22) Filed: Apr. 7, 2014

(65) Prior Publication Data

US 2015/0285261 A1 Oct. 8, 2015

(51) Int. Cl.

| | |
|---|---|
| ***F04D 29/44*** | (2006.01) |
| ***F04D 29/28*** | (2006.01) |
| ***F04D 29/16*** | (2006.01) |
| ***F04D 29/30*** | (2006.01) |

(52) U.S. Cl.

CPC ..... *F04D 29/281* (2013.01); *F04D 29/162* (2013.01); *F04D 29/30* (2013.01)

(58) Field of Classification Search

CPC ..... F04D 29/162; F04D 29/281

See application file for complete search history.

(56) References Cited

U.S. PATENT DOCUMENTS 6,299,409 B1 * 10/2001 Matsunaga ..... F04D 29/162 415/119
2009/0263240 A1 * 10/2009 Okamoto ..... F04D 29/282 415/204
2010/0050678 A1 * 3/2010 Ikeda ..... F04D 17/06 62/291
2012/0211205 A1 * 8/2012 Eguchi ..... F04D 29/4226 165/121
2013/0209245 A1 8/2013 Iyer et al.
2014/0010657 A1 * 1/2014 Iyer ..... F01D 5/02 416/204 R
2015/0192143 A1 * 7/2015 Sakai ..... F04D 29/30 415/203

FOREIGN PATENT DOCUMENTS

| | | | |
|---|---|---|---|
| JP | H10122188 | A | 5/1998 |
| JP | 2014047750 | A | 3/2014 |
| KR | 100133211 | B1 | 12/1997 |

* cited by examiner

*Primary Examiner* — Jesse Bogue
(74) *Attorney, Agent, or Firm* — Fraser Clemens Martin & Miller LLC; James D. Miller

(57) ABSTRACT

A centrifugal blower assembly comprises a scroll housing including a fluid inlet and a spaced apart fluid outlet. An impeller is disposed in the scroll housing and includes a plurality of spaced apart blades arranged annularly around an axis of rotation of the impeller. A portion of each blade adjacent the fluid inlet is spaced apart from the axis of rotation of the impeller a greater distance than a portion of each blade coupled to a hub opposite the fluid inlet. Each of the blades includes a leading edge that is slanted or curved in a radial direction away from the axis of the rotation of the impeller, causing each of the blades to have a more equal distribution of pressure along a length of each of the blades when the impeller is rotated at a constant speed.

20 Claims, 2 Drawing Sheets

BLOWER WITH CURVED BLADES

FIELD OF THE INVENTION

The invention relates to a centrifugal blower, and more specifically to an impeller of a centrifugal blower having an annular array of curved blades.

BACKGROUND OF THE INVENTION

Centrifugal blowers for use in HVAC systems are known in the art. A centrifugal blower is used to impart motion to a gas stream flowing therethrough. A centrifugal blower generally includes an impeller having blades formed on a circumference thereof and a scroll housing surrounding the impeller. A gas enters the centrifugal blower axially through an inlet while rotation of the impeller causes the gas to be directed outwards due to the effects of centrifugal force, causing suction within the center of the impeller. As the gas is directed toward the exterior of the centrifugal blower, the scroll housing directs the gas around the periphery of the centrifugal blower until it exits the centrifugal blower at an outlet.

One potential problem associated with traditional centrifugal blowers is that there is typically an uneven distribution of pressure across the blades of the impeller as the blades extend away from an inlet of the blower. This occurs due to a change in direction of the gas flow as it enters the blower axially before being turned about 90° as it is directed outwards by the rotation of the impeller. The blades of the impeller typically include a linear surface adjacent a central hub of the impeller with the linear surface of the blades arranged in parallel to an axis of rotation of the impeller, as disclosed in U.S. Patent Application Publication No. 2013/0209245 to Iyer et al., which is hereby incorporated herein by reference in its entirety. Gas flowing into the centrifugal blower axially must turn as it enters the space between adjacent blades and is directed outwards. Gas flowing through a central region of the inlet is allowed to turn gradually as it turns towards the blades while air entering the peripheral regions of the inlet must turn much more sharply to enter the spaces between the blades adjacent the inlet of the blower. As a result, the portions of the blades adjacent the inlet of the blower tend to experience a lower gas flow therethrough, negatively affecting the efficiency of the blower. Furthermore, the gas that does flow through the portions of the blades adjacent the inlet tends to experience a greater pressure loss due to turning losses associated with the sharp turn experienced by the gas flow.

Furthermore, traditional blowers tend to experience a large difference in static pressure at different regions within the scroll housing. For instance, the static pressure formed around the periphery of the impeller may be highest adjacent the outlet of the blower. In blowers having impeller blades that do not have an equal distribution of pressure along a length of each blade, there can be situations where the high pressure gas adjacent the outlet will backflow into the low pressure regions of the impeller blades. The backflow into the blades can cause rumble noise to be generated that can propagate through the HVAC system and be heard by a passenger in a vehicle, for example, having the blower installed therein.

It would therefore be desirable to produce a centrifugal blower having a maximized efficiency by providing an even distribution of pressure across the blades of the impeller and minimizing a turning angle of a gas flowing through the centrifugal blower before it strikes a leading edge of each of the blades of the impeller.

SUMMARY OF THE INVENTION

Compatible and attuned with the present invention, a centrifugal blower with maximized efficiency due to minimized turning losses and an equal distribution of dynamic pressure across a length of each blade has surprisingly been discovered.

In one embodiment of the invention, a centrifugal blower assembly comprises a scroll housing including a fluid inlet, a spaced apart fluid outlet, and an impeller disposed in the scroll housing, the impeller including a plurality of spaced apart blades arranged annularly around an axis of rotation of the impeller. A portion of each blade adjacent the fluid inlet is spaced apart from the axis of rotation of the impeller a greater distance than a portion of each blade coupled to a hub opposite the fluid inlet.

In a second embodiment of the invention, a centrifugal blower assembly comprises a scroll housing including a fluid inlet, a spaced apart fluid outlet, and an impeller disposed in the scroll housing, the impeller including a plurality of spaced apart blades arranged annularly around an axis of rotation of the impeller, a first end of each blade coupled to a hub of the impeller and a second end of each blade coupled to an annular inlet ring adjacent the fluid inlet. The second end of each blade is spaced apart from the axis of rotation of the impeller a greater distance than the first end of each blade is spaced apart from the axis of rotation of the impeller.

In yet another embodiment of the invention, a centrifugal blower assembly comprises a scroll housing including a fluid inlet and a spaced apart fluid outlet. The blower assembly also includes an impeller disposed in the scroll housing, the impeller including a plurality of spaced apart blades arranged annularly around an axis of rotation of the impeller, a first end of each blade coupled to a hub of the impeller and a second end of each blade coupled to an annular inlet ring adjacent the fluid inlet, wherein each of the blades includes a leading edge facing the axis of rotation of the impeller and a trailing edge opposite the leading edge. The blower assembly also includes a scroll duct extending around a periphery of the impeller and terminating into the fluid outlet, the fluid outlet extending tangentially from the scroll duct. The scroll housing includes a cutoff edge formed therein, the cutoff edge forming a boundary between the fluid outlet and one end of the scroll duct. The leading edge of each of the blades curves away from the axis of rotation of the impeller as each of the blades extends away from the hub and toward the annular inlet ring, causing the leading edge of each blade to have a convex shape and the trailing edge of each blade to have a concave shape, wherein the cutoff edge has a shape corresponding to the shape of the trailing edge of each blade.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
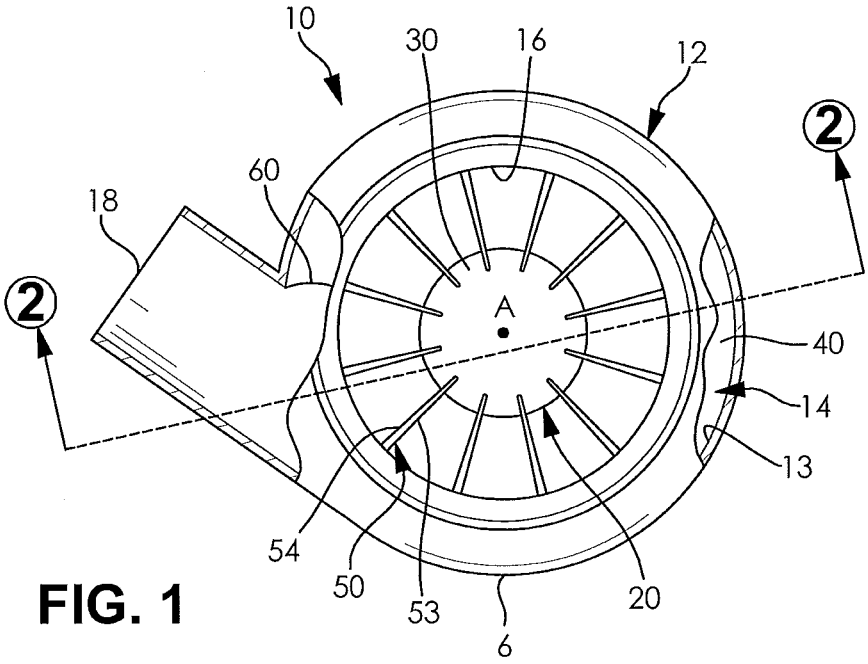
FIG. 1 is a plan view of a centrifugal blower assembly with a portion thereof cut away according to an embodiment of the invention.
Figure 2:
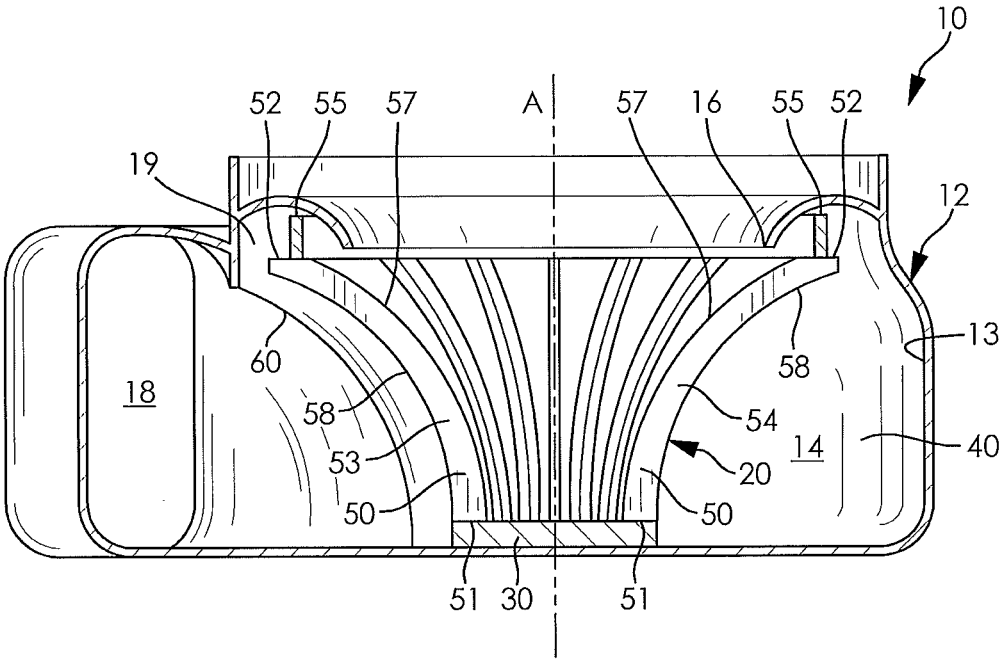
FIG. 2 is a cross-sectional elevational view of the centrifugal blower assembly illustrated in FIG. 1 taken through line 2-2.

FIGS. 1 and 2 show a blower assembly 10 according to an embodiment of the invention. The blower assembly 10 may be adapted for use in climate control applications such as heating, ventilating, and air conditioning (HVAC) systems of a motor vehicle, for example. However, it should be understood that the blower assembly 10 may be adapted for use in any system requiring a forced flow of air.

The blower assembly 10 includes a scroll housing 12 having a hollow compartment 14 formed therein, wherein an interior surface 13 of the scroll housing 12 defines the compartment 14. The scroll housing 12 further includes a fluid inlet 16 and a tangential fluid outlet 18. The fluid inlet 16 provides fluid communication between an inlet conduit (not shown) and the compartment 14 of the scroll housing 12 while the tangential fluid outlet 18 provides fluid communication between an outlet conduit (not shown) and the compartment 14 of the scroll housing 12. The fluid inlet 16 is spaced apart from and arranged substantially perpendicular to the tangential fluid outlet 18, which extends from a circumferential side surface 6 of the scroll housing 12. The tangential fluid outlet 18 extends away from the compartment 14 of the scroll housing 12 in a direction tangential to the circumferential side surface 6 from which it extends.

An impeller 20 is disposed within the compartment 14 of the scroll housing 12. The impeller 20 includes an annular array of spaced apart blades 50 arranged about an axis of rotation A of the impeller 20. The impeller 20 further includes a hub 30 spaced apart axially from the fluid inlet 16, wherein the hub 30 is arranged concentric with the axis of rotation A of the impeller 20 as well as the fluid inlet 16. The hub 30 is disposed on an end of the impeller opposite an end of the impeller 20 adjacent the fluid inlet 16. Each of the blades 50 is coupled to the hub 30 at a first end 51 thereof. A second end 52 of each of the blades 50 is coupled to an annular inlet ring 55 that is disposed within an annular recess 19 formed in the scroll housing 12. The annular recess 19 may be formed radially outwardly from the fluid inlet 16. An inner portion of the interior surface 13 of the scroll housing 12 forming the annular recess 19 may also define the fluid inlet 16, as desired. The impeller 20 shown is typically driven to rotate about the axis of rotation A by a motor (not shown). However, it should be understood that the impeller 20 may be caused to rotate by another means as desired.

A scroll duct 40 extends around a periphery of the impeller 20 between the annular array of blades 50 and the interior surface 13 of the scroll housing 12. The scroll duct 40 may have a smaller cross-sectional area to one side of a cutoff edge 60 adjacent the tangential fluid outlet 18, where the cutoff edge 60 is a portion of the interior surface 13 of the scroll housing 12 in close proximity to the impeller 20 that also forms a portion of an inner wall of the tangential fluid outlet 18. The cutoff edge 60 effectively functions as a boundary between one end of the scroll duct 40 and the tangential fluid outlet 18. As shown in FIG. 1, the cutoff edge 60 may also be considered to be a beginning portion of a flow channel extending around the impeller 20 in a clockwise direction, wherein the flow channel includes the scroll duct 40 and the tangential fluid outlet 18. As the scroll duct 40 extends around the periphery of the impeller 20, the cross-sectional area thereof may gradually increase until the scroll duct 40 terminates into the tangential fluid outlet 18.

Referring now to FIG. 2, each of the blades 50 includes a leading edge 57 and a trailing edge 58, wherein each edge 57, 58 extends from the hub 30 to the annular inlet ring 55. The leading edge 57 of each blade 50 refers to a radial inner edge of each blade 50 in facing relationship with the axis of rotation A of the impeller 20, while the trailing edge 58 of each blade 50 refers to a radial outer edge of each blade 50 in facing relationship with the scroll duct 40. As best illustrated in FIG. 1, each of the blades 50 further includes a first surface 53 and an opposing second surface 54, wherein each of the first surface 53 and the second surface 54 connects the leading edge 57 of each blade 50 to the trailing edge 58 of each blade 50, respectively.

As is known in the art, it may be advantageous for the blower assembly 10 to have forward-curved blades, backward-curved blades, or straight-radial blades, depending on a desired flow rate and pressure of a fluid exiting the blower assembly 10. In the case of forward-curved blades, the first surface 53 may have a generally concave shape facing in a direction of rotation of the impeller 20 while the second surface 54 may have a generally convex shape. In the case of backward-curved blades, the first surface 53 may have a generally convex shape facing in a direction of rotation of the impeller 20 while the second surface 54 may have a generally concave shape. In the case of straight-radial blades, each of the first surface 53 and the second surface 54 may be generally planar and linear, as shown in FIG. 1.

Additionally, the hub 30 of the impeller 20 may also include a central baffle portion extending from a base of the hub 30 and toward the fluid inlet 16 for directing a flow of air toward the blades 50 arranged around the hub 30. The baffle portion may be substantially conical in shape with a peak of the conical shape being aligned concentric with the axis of rotation A. The hub 30 may for instance have a shape similar to that disclosed in U.S. Patent Application Publication No. 2013/0209245 to Iyer et al. However, the shape and arrangement of the blades 50 of the impeller 20 may cause the blower assembly 10 to not require the baffle portion of the hub 30, as is explained hereinafter in greater detail.

Each of the blades 50 has a generally arcuate or curved profile, as best shown in FIG. 2. A profile of the leading edge 57 of each blade 50 has a generally convex shape while a profile of the corresponding trailing edge 58 of each blade 50 has a generally concave shape. The leading edge 57 of each blade 50 may be substantially parallel to and equally spaced apart from the corresponding trailing edge 58 of each blade 50 along a length thereof. The first end 51 of each blade 50, which is coupled to a periphery of the hub 30, is spaced apart radially from the axis of rotation A of the impeller 20 a distance that is less than a distance the second end 52 of each blade 50, which is coupled to the annular inlet ring 55, is spaced apart radially from the axis of rotation A. The leading edge 57 and the corresponding trailing edge 58 of each blade 50 may be arranged substantially parallel to the axis of rotation A of the impeller 20 at the first end 51 of each blade 50 adjacent the hub 30. The leading edge 57 and the corresponding trailing edge 58 of each blade 50 may be arranged substantially perpendicular to the axis of rotation A of the impeller 20 at the second end 52 of each blade 50 adjacent the annular inlet ring 55. However, other arrangements of the leading edge 57 and the trailing edge 58 may be used, as best illustrated in FIGS. 3A-3D.

Figure 3A:
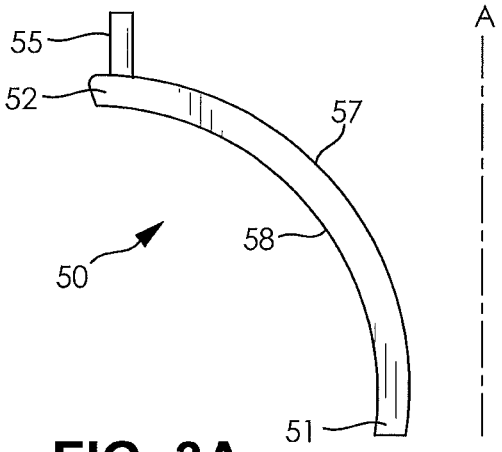
FIG. 3A is a side elevational view of a blade of the centrifugal blower assembly illustrated in FIGS. 1 and 2.
Figure 3B:
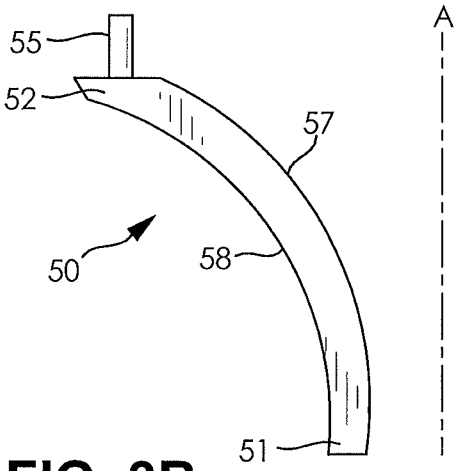
FIG. 3B is a side elevational view of a blade of the centrifugal blower assembly illustrated in FIGS. 1 and 2 according to another embodiment of the invention.
Figure 3C:
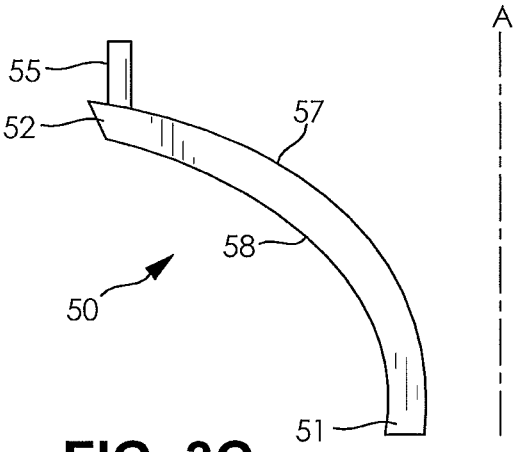
FIG. 3C is a side elevational view of a blade of the centrifugal blower assembly illustrated in FIGS. 1 and 2 according to another embodiment of the invention.
Figure 3D:
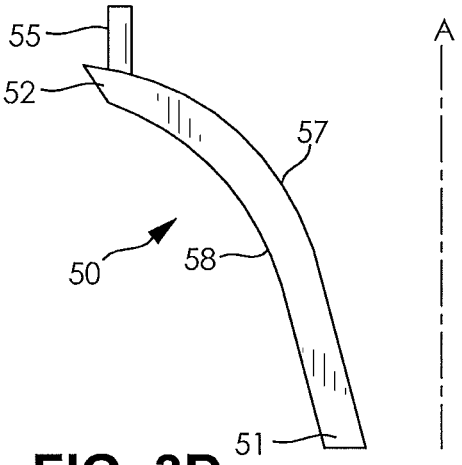
FIG. 3D is a side elevational view of a blade of the centrifugal blower assembly illustrated in FIGS. 1 and 2 according to another embodiment of the invention.

In one embodiment shown in FIG. 3A, the leading edge 57 and the trailing edge 58 of each blade 50 may have a curved shape that has a substantially constant radius of curvature extending from the first end 51 of each blade 50 to the second end 52 of each blade 50. In other embodiments, the radius of curvature of the leading and trailing edges 57, 58 may vary from the first end 51 of each blade 50 to the second end 52 of each blade 50. For instance, the radius of curvature of the leading and trailing edges 57, 58 of each blade 50 adjacent the first end 51 of each blade 50 may be larger than a radius of curvature of the leading and trailing edges 57, 58 of each blade 50 adjacent the second end 52 of each blade 50, as shown in FIG. 3B. Alternatively, the radius of curvature of the leading and trailing edges 57, 58 of each blade 50 adjacent the first end 51 of each blade 50 may be smaller than a radius of curvature of the leading and trailing edges 57, 58 of each blade 50 adjacent the second end 52 of each blade 50, as shown in FIG. 3C. As another example, each of the blades 50 may include a substantially linear portion adjacent the first end 51 of each blade 50 that is disposed at an angle with respect to the axis of rotation A before transitioning into a curved portion, as shown in FIG. 3D. The linear portion of each of the blades 50 is angled to extend away from the axis of rotation A as each of the blades 50 extends away from the hub 30 and toward the annular inlet ring 55.

Furthermore, as shown in FIG. 2, the cutoff edge 60 of the scroll housing 12 may have a profile that generally conforms to the profile of the trailing edge 58 of each blade 50 while being spaced apart therefrom. This causes an interior wall of the tangential fluid outlet 18 to also have a profile generally conforming to the profile of the trailing edge 58 of each blade 50 adjacent a transition from the scroll duct 40 to the tangential fluid outlet 18.

Although the impeller 20 is shown as having twelve blades 50 in FIGS. 1 and 2, it should be understood that any number of the blades 50 may be utilized while remaining within the scope of the current invention. A number of the blades 50 utilized in the blower assembly 10 may be determined based on the desired characteristics of the air flowing through the blower assembly 10, such as a desired pressure and a desired flow rate thereof.

In use, air is caused to flow into the fluid inlet 16 while the impeller 20 is rotated about the axis of rotation A in a direction running from the portion of the scroll duct 40 adjacent the cutoff edge 60 and around the scroll housing 12 toward the tangential fluid outlet 18. The direction of rotation of the impeller 20 is shown as being clockwise in FIG. 1. The blower assembly 10 uses the centrifugal power generated from the rotation of the impeller 20 to increase the pressure of the air flowing through the spaces between each adjacent blade 50. When the impeller 20 rotates, the air encountering the leading edge 57 of each blade 50 is directed toward the trailing edge 58 thereof due to the centrifugal force generated by the rotation of the blades 50 about the axis of rotation A. As a result, the air pressure in the scroll duct 40 is increased. The air is then guided around the scroll duct 40 in the direction of rotation of the impeller 20 toward the tangential fluid outlet 18, where the air leaves the blower assembly 10. After the air is directed from each blade 50 and toward the scroll duct 40, the air pressure in the central region of the impeller 20 between the leading edges 57 of the blades 50 decreases. The air entering the blower assembly 10 through the fluid inlet 16 flows into the central region of the impeller 20 to normalize the pressure therein. This cycle repeats, and the air can be continuously transferred from the fluid inlet 16 to the tangential fluid outlet 18 by means of the rotation of the impeller 20.

The curved or slanted profile of the leading and trailing edges 57, 58 of each of the blades 50 offers several advantages over the impeller blades of prior art blower assemblies having blades arranged in parallel to an axis of rotation thereof. For instance, because the blades 50 curve outwardly as the blades 50 extend from the hub 30, the fluid inlet 16 of the scroll housing 12 can be larger than in traditional blower assemblies. This allows for greater flexibility in design, as the blower assembly 10 can be adapted to accommodate a wide range of flow rates and internal pressures that may not be possible with a traditional blower assembly.

Additionally, the curved profile of the blades 50 reduces the amount that the air passing through the fluid inlet 16 must turn in order to be directed past the blades 50 and into the scroll duct 40 in a radial direction with respect to the axis of rotation A of the impeller 20. In traditional blower assemblies having blades arranged parallel to the axis of rotation thereof, the air immediately adjacent the fluid inlet of the scroll housing must turn sharply (as much as 90°) to pass by the portions of each blade adjacent the fluid inlet. Causing the air to turn sharply adjacent the fluid inlet of traditional blower assemblies often causes the portions of the blades immediately adjacent the fluid inlet to experience a smaller amount of air flow therethrough, rendering those portions of the blades to be less efficient in transferring air through the blower assembly.

Additionally, the turning losses experienced by the air changing direction quickly adjacent the fluid inlet may cause the magnitude of the velocity of the air passing therebetween to be lower than the magnitude of the velocity of the air that turns more gradually as it encounters the leading edge of each of the blades at a portion of the blades closer to the hub of the impeller, which may affect a distribution of dynamic pressure across a length of each of the blades. The dynamic pressure of the air passing through the blades of the impeller is provided by the following equation:

$$q = \frac{1}{2}\rho v^2$$

In the given equation, q is the dynamic pressure of the fluid, ρ is the density of the fluid, and v is the total fluid velocity. The total fluid velocity v of the air passing through the blades of the impeller is a sum of the linear tangential velocity of the blades that the air passes between and the relative velocity of the air as it contacts the blades of the impeller. The linear tangential velocity of the blades will be constant across a length of each blade in a traditional blower assembly due to the blades being arranged in parallel to the axis of rotation thereof. Also, as should be understood, the relative velocity of the air as it contacts the blades is affected by both the amount the air is slowed due to turning losses as well as the angle at which the air strikes the leading edge of each blade. As a result, the dynamic pressure of air flowing through the blades of a traditional blower assembly may vary substantially along a length of each of the blades. Typically, the dynamic pressure of the air flowing across a portion of each of the blades adjacent the fluid inlet will be substantially lower than the dynamic pressure of the air flowing across a remainder of each of the blades as the blades extend away from the fluid inlet.

In contrast, the leading edge 57 of each of the blades 50 of the blower assembly 10 curves away from the axis of rotation A as the blades 50 extend from the hub 30 and toward the annular inlet ring 55. This causes each of the blades 50 to have a varied magnitude of linear tangential velocity along a length thereof during a constant rate of rotation of the impeller 20, with the magnitude of the linear tangential velocity being greatest adjacent the fluid inlet 16 due to the second end 52 of each blade 50 being disposed a greater distance from the axis of rotation A. Accordingly, the blades 50 can be slanted or curved outwardly from the axis of rotation A in a manner that allows the dynamic pressure across a length of each blade 50 to be substantially constant, as the increasing magnitude of linear tangential blade velocity of each blade 50 as the blades 50 extend toward the annular inlet ring 55 compensates for any loss in relative velocity of the air due to the turning angle the air must undergo to pass through the blades 50 adjacent the fluid inlet 16.

The more even distribution of dynamic pressure, and hence total pressure, along the length of each of the blades 50 offers several advantages. First, the overall efficiency of the blower assembly 10 is increased as the portion of each blade 50 adjacent the fluid inlet 16 experiences greater air flow and the air flowing therethrough experiences increased dynamic pressure. This allows the blower assembly 10 to accomplish greater air pressures at the same rate of rotation as a traditional blower. Alternatively, the blower assembly 10 may be rotated at a slower rate than a traditional blower while still achieving a desired increase in pressure of the air flowing therethrough, which can reduce energy consumption and noise when compared to a traditional blower assembly.

Second, the more even distribution of total pressure across the blades 50 can aid in reducing backflow into the blades 50, especially adjacent the cutoff edge 60. In traditional blower assemblies, as the air leaves the trailing edge of each blade it is caused to flow around the scroll duct formed in the housing until the air reaches the fluid outlet adjacent the cutoff edge. As the air flows around the scroll duct and toward the fluid outlet, a static pressure of the air increases, causing the region of the scroll duct adjacent the cutoff edge to experience a greater total pressure than a remainder of the scroll duct. In some circumstances, the decreased dynamic pressure of the air flowing across the portion of each blade adjacent the fluid inlet can cause the air having a greater total pressure adjacent the cutoff edge to backflow into the blades due to the difference in pressure therebetween. This not only affects an efficiency of the blower assembly, but also may cause noise to be generated that may be heard by a driver in a passenger compartment of a vehicle having the traditional blower assembly installed therein. The noise can be a result of turbulence generated by the air back-flowing into the rotating blades of the impeller.

In contrast, the blower assembly 10 having the curved blades 50 reduces the likelihood of backflow due to the more even distribution of pressure along the length of each of the blades 50, including the portions of each blade 50 adjacent the fluid inlet 16.

The manner in which each of the blades 50 extends away from the axis of rotation A of the impeller 20 may also aid in reducing noise generation caused by a lack of stability of the impeller 20 as it rotates. The second end 52 of each blade 50 being disposed a distance further from the axis of rotation A than in a traditional blower assembly allows the impeller 20 to have a greater moment of inertia. As a result, the impeller 20 may resist changes to its rotational velocity to a greater degree than a traditional impeller, causing the impeller 20 to have greater stability when operating at a constant rate of rotation.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A centrifugal blower assembly comprising:

a scroll housing including a fluid inlet and a spaced apart fluid outlet; and an impeller disposed in the scroll housing, the impeller including a hub having a planar upper surface and a plurality of spaced apart blades arranged annularly around an axis of rotation of the impeller, wherein each blade includes a first end spaced apart from the fluid inlet and a second end adjacent the fluid inlet, wherein the entire length of the first end of each blade is coupled to the hub and the second end of each blade is spaced apart from the axis of rotation of the impeller a greater distance than the first end of each blade.

2. The centrifugal blower assembly of claim 1, wherein each of the blades has a leading edge facing toward the axis of rotation of the impeller and includes a curved portion.

3. The centrifugal blower assembly of claim 2, wherein the curved portion of the leading edge of each blade is convex in shape.

4. The centrifugal blower assembly of claim 3, wherein each of the blades includes a trailing edge opposite the leading edge thereof, wherein the trailing edge of each blade includes a portion having a concave shape corresponding to the convex shape of the leading edge.

5. The centrifugal blower assembly of claim 4, wherein the scroll housing further includes a cutoff edge having a shape corresponding to the trailing edge of each blade.

6. The centrifugal blower assembly of claim 3, wherein a radius of curvature of the curved portion of the leading edge is greater adjacent the first end of each blade than is a radius of curvature of the curved portion of the leading edge adjacent the second end of each blade.

7. The centrifugal blower assembly of claim 3, wherein the curved portion of the leading edge of each blade is formed adjacent the fluid inlet and a remaining portion of the leading edge of each blade has a linear profile.

8. The centrifugal blower assembly of claim 7, wherein the linear profile of the leading edge of each blade is disposed at an angle with respect to the axis of rotation of the impeller.

9. The centrifugal blower assembly of claim 3, wherein the convex shape of the curved portion of the leading edge of each blade equalizes a pressure distribution across a length of each of the blades.

10. The centrifugal blower assembly of claim 1, wherein the second end of each of the blades is coupled to an annular inlet ring.

11. The centrifugal blower assembly of claim 1, wherein a scroll duct is formed in the scroll housing around a periphery of the impeller, the scroll duct terminating into the fluid outlet, wherein the fluid outlet extends tangentially from the scroll duct.

12. A centrifugal blower assembly comprising:

a scroll housing including a fluid inlet and a spaced apart fluid outlet; and an impeller disposed in the scroll housing, the impeller including a hub having a planar upper surface, an annular inlet ring adjacent the fluid inlet, and a plurality of spaced apart blades arranged annularly around an axis of rotation of the impeller, an entire length of a first end of each blade coupled to the hub and a second end of each blade coupled to the annular inlet ring, wherein the second end of each blade is spaced apart from the axis of rotation of the impeller a greater distance than the first end of each blade is spaced apart from the axis of rotation of the impeller.

13. The centrifugal blower assembly of claim 12, wherein each of the blades curves away from the axis of rotation of the impeller as the blades extend away from the hub and toward the annular inlet ring.

14. The centrifugal blower assembly of claim 13, wherein each of the blades includes a leading edge facing the axis of rotation of the impeller and a corresponding trailing edge opposite the leading edge thereof, the leading edge having a convex shape and the trailing edge having a concave shape.

15. The centrifugal blower assembly of claim 14, wherein the scroll housing further includes a cutoff edge formed therein, the cutoff edge forming a boundary between the fluid outlet and one end of a scroll duct disposed around a periphery of the impeller for directing air toward the fluid outlet.

16. The centrifugal blower assembly of claim 15, wherein the cutoff edge has a shape corresponding to the shape of the trailing edge of each of the blades.

17. The centrifugal blower assembly of claim 14, wherein a radius of curvature of the leading edge of each blade adjacent the first end of each blade is greater than a radius of curvature of the leading edge of each blade adjacent the second end of each blade.

18. The centrifugal blower assembly of claim 13, wherein the leading edge of each blade includes a linear portion and a curved portion, wherein the linear portion of each blade slants away from the axis of rotation of the impeller as each blade extends away from the hub before transitioning to the curved portion thereof.

19. The centrifugal blower assembly of claim 12, wherein a distribution of pressure across each of the blades is constant along a length of each of the blades.

20. A centrifugal blower assembly comprising:

a scroll housing including a fluid inlet and a spaced apart fluid outlet;

an impeller disposed in the scroll housing, the impeller including a hub having a planar upper surface, an annular inlet ring adjacent the fluid inlet, and a plurality of spaced apart blades arranged annularly around an axis of rotation of the impeller, an entire length of a first end of each blade coupled to the hub and a second end of each blade coupled to the annular inlet ring, wherein each of the blades includes a leading edge facing the axis of rotation of the impeller and a trailing edge opposite the leading edge;

a scroll duct extending around a periphery of the impeller and terminating into the fluid outlet, the fluid outlet extending tangentially from the scroll duct; and a cutoff edge formed in the scroll housing, the cutoff edge forming a boundary between the fluid outlet and one end of the scroll duct;

wherein the leading edge of each of the blades curves away from the axis of rotation of the impeller as each of the blades extends away from the hub and toward the annular inlet ring, causing the leading edge of each blade to have a convex shape and the trailing edge of each blade to have a concave shape, wherein the cutoff edge has a shape corresponding to the shape of the trailing edge of each blade.

* * * * *